US008096650B2

(12) United States Patent
McConville

(10) Patent No.: US 8,096,650 B2
(45) Date of Patent: Jan. 17, 2012

(54) DUPLEX PRINTING WITH INTEGRATED IMAGE MARKING ENGINES

(75) Inventor: Paul McConville, Webster, NY (US)

(73) Assignee: Xerox Corporation, Norwalk, CT (US)

( * ) Notice: Subject to any disclaimer, the term of this patent is extended or adjusted under 35 U.S.C. 154(b) by 511 days.

(21) Appl. No.: 12/180,970

(22) Filed: Jul. 28, 2008

(65) Prior Publication Data

US 2010/0020119 A1 Jan. 28, 2010

(51) Int. Cl.
*B41J 2/01* (2006.01)

(52) U.S. Cl. ..... 347/103; 399/45

(58) Field of Classification Search ..... 347/9, 101; 355/24, 309; 358/296; 399/2, 45, 101, 364, 399/381
See application file for complete search history.

(56) References Cited

U.S. PATENT DOCUMENTS

| | | | | |
|---|---|---|---|---|
| 4,591,884 | A | 5/1986 | Miyamoto | |
| 4,958,187 | A * | 9/1990 | Tsuchiya et al. | 399/306 |
| 5,041,866 | A | 8/1991 | Imoto | |
| 5,208,640 | A | 5/1993 | Horie | |
| 5,389,958 | A | 2/1995 | Bui et al. | |
| 5,452,959 | A * | 9/1995 | Oka | 400/149 |
| 5,568,246 | A * | 10/1996 | Keller et al. | 399/382 |
| 5,596,416 | A * | 1/1997 | Barry et al. | 358/296 |
| 5,777,576 | A * | 7/1998 | Zur et al. | 347/120 |
| 5,805,191 | A | 9/1998 | Jones | |
| 6,032,015 | A * | 2/2000 | Umeda et al. | 399/306 |
| 6,196,675 | B1 | 3/2001 | Deily | |
| 6,222,606 | B1 * | 4/2001 | Fuchiwaki et al. | 355/24 |
| 6,450,711 | B1 * | 9/2002 | Conrow | 400/582 |
| 6,487,388 | B2 * | 11/2002 | Theodoulou et al. | 399/307 |
| 6,494,570 | B1 * | 12/2002 | Snyder | 347/103 |
| 6,508,551 | B1 | 1/2003 | Snyder | |
| 7,136,616 | B2 | 11/2006 | Mandel | |
| 7,188,929 | B2 | 3/2007 | Lofthus | |
| 7,310,108 | B2 | 12/2007 | Moore | |
| 2002/0067934 | A1 * | 6/2002 | Jia et al. | 399/302 |
| 2003/0077095 | A1 * | 4/2003 | Conrow | 399/364 |
| 2003/0103123 | A1 * | 6/2003 | Snyder | 347/102 |
| 2004/0028436 | A1 * | 2/2004 | Suzuki et al. | 399/381 |
| 2004/0239990 | A1 * | 12/2004 | Silverbrook et al. | 358/1.15 |
| 2005/0074260 | A1 * | 4/2005 | King et al. | 399/222 |
| 2006/0115306 | A1 * | 6/2006 | Lofthus et al. | 399/341 |
| 2006/0158496 | A1 * | 7/2006 | Odell et al. | 347/100 |
| 2006/0221159 | A1 * | 10/2006 | Moore et al. | 347/101 |
| 2006/0222378 | A1 * | 10/2006 | Julien | 399/2 |
| 2006/0250467 | A1 * | 11/2006 | Folkins | 347/103 |
| 2007/0071465 | A1 * | 3/2007 | Hamby et al. | 399/45 |
| 2007/0081064 | A1 * | 4/2007 | Spencer et al. | 347/104 |
| 2007/0081828 | A1 * | 4/2007 | Radulski et al. | 399/27 |
| 2007/0159670 | A1 * | 7/2007 | Lofthus et al. | 358/498 |

* cited by examiner

*Primary Examiner* — Charlie Peng
*Assistant Examiner* — Peter Radkowski
(74) *Attorney, Agent, or Firm* — Fay Sharpe LLP

(57) ABSTRACT

The present disclosure provides a method for controlling printing in a solid ink jet printing system. The method comprises forming a first ink image and a second ink image on a transfer surface; passing a receiving substrate through a first nip simplex path of a first ink jet printer at a first print speed; exerting a first pressure on the receiving substrate in the first nip to transfer the first ink image from the transfer surface to a first side of the receiving substrate; moving the receiving substrate through an inverter path; passing the receiving substrate through a second nip simplex path of a second ink jet printer at a second print speed; and, exerting a second pressure on the receiving substrate in the second nip to transfer the second ink image from the transfer surface to a second side of the receiving substrate.

11 Claims, 4 Drawing Sheets

DUPLEX PRINTING WITH INTEGRATED IMAGE MARKING ENGINES

BACKGROUND

The present disclosure relates generally to an imaging process. More specifically, the disclosure relates to an application system for applying a duplex process wherein single pass duplexing is achieved using more than one integrated image marking engine.

Ink jet printing systems utilizing intermediate transfer ink jet recording methods, such as that disclosed in U.S. Pat. No. 5,389,958 (the '958 patent) entitled IMAGING PROCESS and assigned to the assignee of the present application, is an example of an indirect or offset printing architecture that utilizes phase change ink. A release agent application defining an intermediate transfer surface is applied by a wicking pad that is housed within an applicator apparatus. Prior to imaging, the applicator is raised into contact with the rotating drum to apply or replenish the liquid intermediate transfer surface.

Once the liquid intermediate transfer surface has been applied, the applicator is retracted and the print head ejects drops of ink to form the ink image on the liquid intermediate transfer surface. The ink is applied in molten form, having been melted from its solid state form. The ink image solidifies on the liquid intermediate transfer surface by cooling to a malleable solid intermediate state as the drum continues to rotate. When the imaging has been completed, a transfer roller is moved into contact with the drum to form a pressurized transfer nip between the roller and the curved surface of the intermediate transfer surface/drum. A final receiving substrate, such as a sheet of media, is then fed into the transfer nip and the ink image is transferred to the final receiving substrate.

To provide acceptable image transfer and final image quality, an appropriate combination of pressure and temperature must be applied to the ink image on the final receiving substrate. U.S. Pat. No. 6,196,675 entitled APPARATUS AND METHOD FOR IMAGE FUSING and assigned to the assignee of the present application (the '675 patent) discloses a roller for fixing an ink image on a final receiving substrate. An embodiment of the roller is described in the context of an offset ink jet printing apparatus similar to the one described in the '958 patent. In this embodiment, an apparatus and related method for improved image fusing in an ink jet printing system are provided. An ink image is transferred to a final receiving substrate by passing the substrate through a transfer nip. The substrate and ink image are then passed through a fusing nip that fuses the ink image into the final receiving substrate. Utilizing separate image transfer and image fusing operations allows improved image fusing and faster print speeds.

Various apparatuses for recording images on sheets have heretofore been put into practical use. For example, there are copying apparatuses of the type in which the images of originals are recorded on sheets through a photosensitive medium or the like, and printers in which image information transformed into an electrical signal is reproduced as an image on a sheet by an impact system (the type system, the wire dot system or the like) or a non-impact system (the thermosensitive system, the ink jet system, the laser beam system or the like).

The present exemplary embodiments relate to a plurality of image marking engines or image recording apparatuses, and media feeder modules, providing a multifunctional and expandable printing system. It finds particular application in conjunction with integrated printing modules having several marking engines, each having customizable or different printing capabilities, and will be described with particular reference thereto. However, it is to be appreciated that the present exemplary embodiment is also amenable to other like applications.

It is common practice to record images not only on one surface of the sheet, but also on both surfaces of a sheet. Copying or printing on both sides of a sheet decreases the number of sheets used from the viewpoint of saving of resources or filing space. In this regard as well, a system has been put into practical use whereby sheets having images recorded on a first surface thereof are once accumulated and after the recording on the first surface is completed, the accumulated sheets are then fed and images are recorded on a second surface thereof. However, this system is efficient when many sheets having a record of the same content are to be prepared, but is very inefficient when many sheets having different records on both surfaces thereof are to be prepared. That is, when pages 1, 2, 3, 4, . . . are to be prepared, odd pages, i.e. pages 1, 3, 5, . . . , must first be recorded on the first surface of the respective sheets, and then these sheets must be fed again and even pages 2, 4, 6, . . . must be recorded on the second surface of the respective sheets. If, during the second feeding, multiplex feeding or jam of sheets should occur, the combination of the front and back pages may become mixed, thereby necessitating recording be done over again from the beginning. To avoid this, recording may be effected on each sheet in such a manner that the front and back surfaces of each sheet provide the front and back pages, respectively, but this takes time (reduction in ppm) for the refeeding of sheets and the efficiency is reduced.

In recent years, the demand for even higher productivity and speed has been required of these image recording apparatuses. However, the respective systems have their own media feed and image processing speed limits and if an attempt is made to provide higher speeds, numerous problems will occur and/or larger and more bulky apparatuses must be used to meet the higher speed demands. The larger and bulkier apparatuses, i.e. high speed printers, typically represent a very expensive and uneconomical apparatus. The expense of these apparatuses along with their inherent complexity can only be justified by the small percentage of extremely high volume printing customers.

U.S. Pat. Nos. 4,591,884; 5,208,640; and U.S. Pat. No. 5,041,866 are incorporated by reference as background information.

Currently duplex print quality issues associated with a standard ink jet duplex print processes are addressed via reduced duplex productivity (reduced ppm). This is best exemplified in a slowdown algorithm that can be used wherein, depending on the image content, the duplex speed is either 24 ppm or 38 ppm while the simplex speed is 50 ppm.

For a series of integrated printers, using solid ink jet (SIJ) print engines, this disclosure proposes a duplex print mode where one engine exclusively prints the first side of duplex and another engine prints the second side of the duplex. This can increase the duplex print speed, i.e. to 38 ppm, independent of image content. Furthermore, the duplex image quality will be improved because the configuration enables maintenance of one of the print engine's transfix roll for gloss, offset, and roller ghosting while at the same time, the other print engine's transfix roll can be run so that no drum touches are achieved thus transferring no oil to the backside of the sheet which is the known issue for duplex dropout.

BRIEF DESCRIPTION

It is an aspect of the present disclosure to provide an imaging method and apparatus which allows high quality imaging and improved throughput speed (i.e. duplex throughput speed).

Accordingly, the present disclosure provides a method for controlling printing in a solid ink jet printing system. The method comprises forming a first ink image and a second ink image on a transfer surface; passing a receiving substrate through a first nip simplex path of a first ink jet printer at a first print speed; exerting a first pressure on the receiving substrate in the first nip to transfer the first ink image from the transfer surface to a first side of the receiving substrate; moving the receiving substrate through an inverter path; passing the receiving substrate through a second nip simplex path of a second ink jet printer at a second print speed; and, exerting a second pressure on the receiving substrate in the second nip to transfer the second ink image from the transfer surface to a second side of the receiving substrate.

Still another aspect of the present disclosure provides an apparatus for controlling printing in an ink jet printing system. The system comprises a first ink image and a second ink image formed on a transfer surface; a receiving substrate is passed through a first nip of a first ink jet printer at a first print speed; wherein the first nip can be between a first roller and a first drum, and the first roller includes a selectively non-oiled transfix roller surface. The system further comprises a first pressure exerted on the receiving substrate in the first nip to transfer the first ink image from the transfer surface to a first side of the receiving substrate, the receiving substrate is pulled through an inverter path, the receiving substrate passed through a second nip of a second ink jet printer at a second print speed, wherein a second pressure is exerted on the receiving substrate in the second nip to transfer the second ink image from the transfer surface to a second side of the receiving substrate. The second nip is between a soft roller and a hard drum, the soft roller includes a selectively oiled transfix roller surface.

In accordance with another aspect of the present exemplary embodiment, an ink jet print application system is provided comprising a first ink image and a second ink image formed on a transfer surface. A receiving substrate is passed through a first nip of at least one ink jet printer at a first print speed wherein the first nip is between a first roller and a first drum. The first roller includes a non-oiled transfix roller. The system further provides a first pressure exerted on the receiving substrate in the first nip to transfer the first ink image from the transfer surface to a first side of the receiving substrate. The receiving substrate is pulled through an inverter path. The receiving substrate is passed through a second nip of at least another ink jet printer at a second print speed wherein a second pressure exerted the receiving substrate in the second nip to transfer the second ink image from the transfer surface to a second side of the receiving substrate. The second nip is between a second roller and a second drum and the second roller includes an oiled transfix roller. The system further provides for circulating the receiving substrate from the at least one ink jet printer to an input module for distribution of the receiving substrate in a selected order to and from at least one ink jet printer by way of at least one forward substantially horizontal media transport and at least one return substantially horizontal media transport wherein the receiving substrate selectively enters and exits any one of the ink jet printers and selectively enters any other one of the ink jet printers.

BRIEF DESCRIPTION OF THE DRAWINGS

The aspects, features and advantages of the disclosure will become apparent upon consideration of the following, especially when it is taken in conjunction with the accompanying drawings wherein.

DETAILED DESCRIPTION

While the present printing apparatus and method will hereinafter be described in connection with illustrated embodiments, it will be understood that it is not intended to limit the embodiments. On the contrary, it is intended to cover all alternatives, modifications and equivalents as may be included within the spirit and scope of the embodiments as defined by the appended claims.

Figure 1:
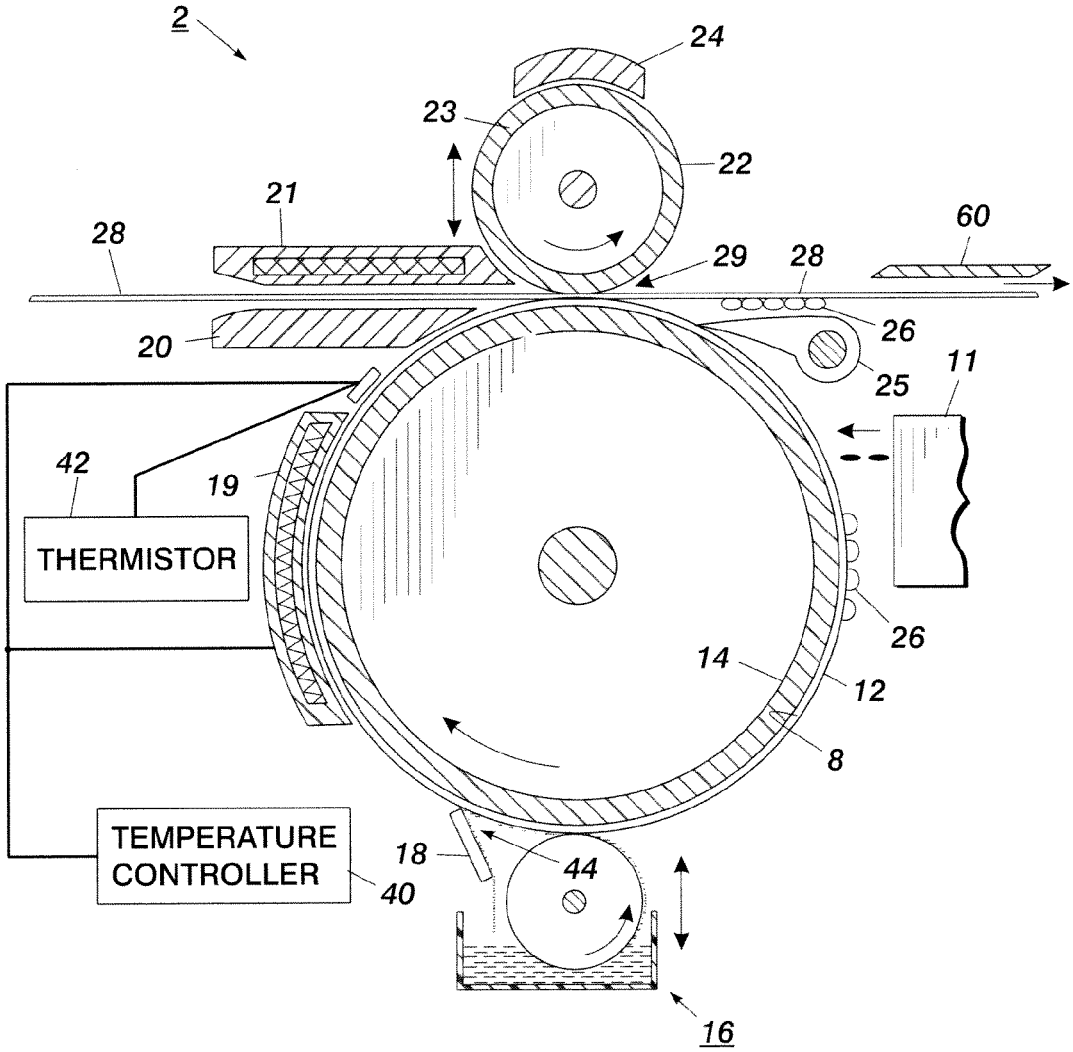
FIG. 1 is a diagrammatic illustration of the present disclosure for applying a transfix process on a first side of a substrate in an ink jet printing system.
Figure 2:
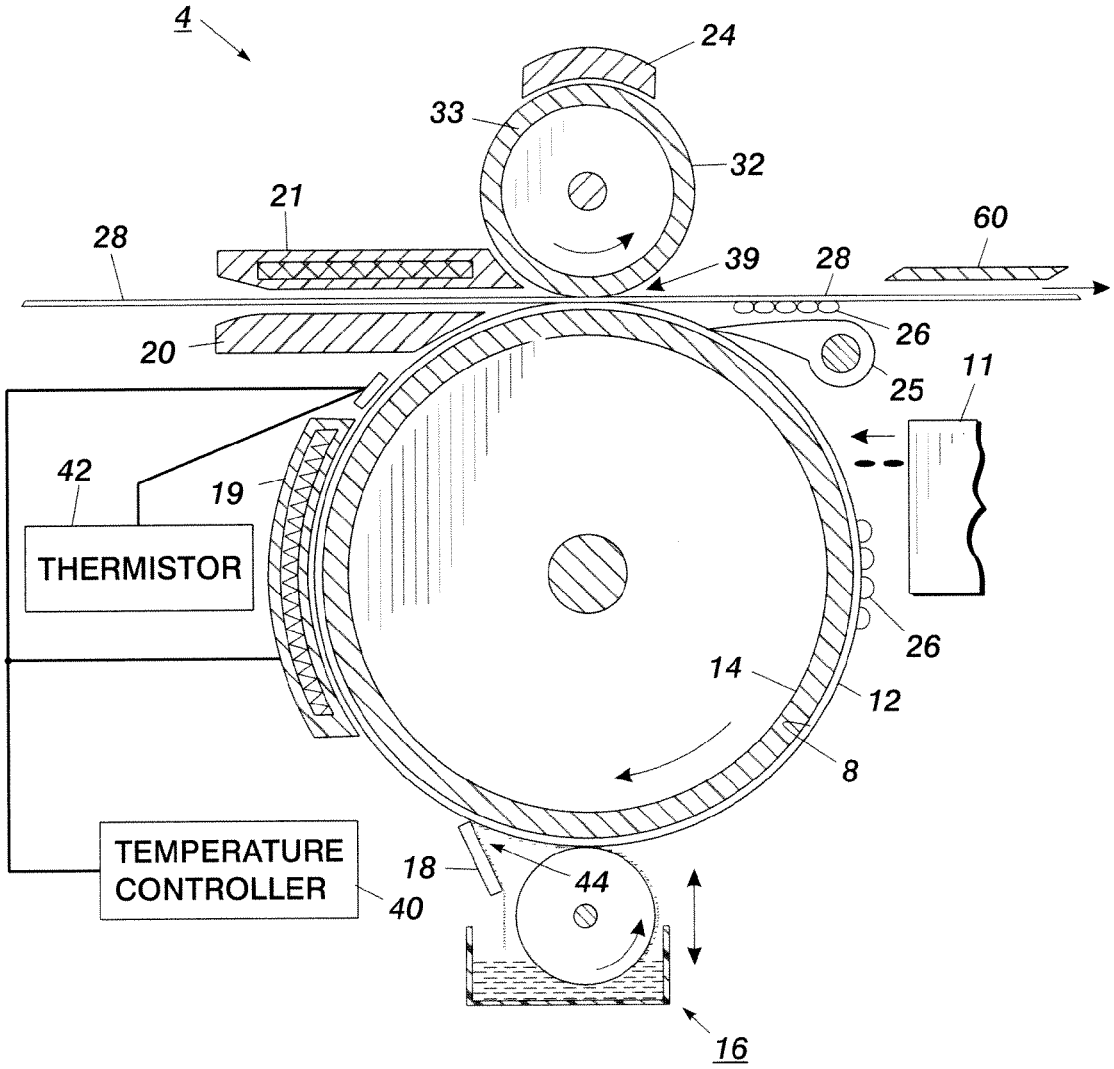
FIG. 2 is an enlarged diagrammatic illustration of duplexing the receiving substrate for transfixing the ink image on a second side in accordance with the present disclosure.

FIGS. 1 and 2 disclose diagrammatical illustrations of an imaging apparatus 2, 4 respectively, of the present disclosure for applying a transfix process whereby a hot melt ink is printed onto an elastomer transfer surface for transference to a receiving substrate and then transported through a fuser for post fusing. FIGS. 1 and 2 diagrammatically illustrate duplexing the receiving substrate for re-transfixing and/or finishing the hot melt ink in accordance with the present disclosure, as will be more fully described below. Referring to both FIGS. 1 and 2 wherein like numerals refer to like or corresponding parts throughout, there is shown a print head 11 having ink jets supported by appropriate housing and support elements (not shown) for either stationary or moving utilization to deposit ink onto an intermediate transfer surface 12. The ink utilized can be initially in solid form and then changed to a molten state by the application of heat energy to raise the temperature from about 85 degrees to about 150 degrees centigrade. Elevated temperatures above this range will cause degradation or chemical breakdown of the ink. The molten ink is then applied in raster fashion from ink jets in the print head 11 to the intermediate transfer surface 12 forming an ink image. The ink image is then cooled to an intermediate temperature and solidifies to a malleable state wherein it is transferred to a receiving substrate or media 28 and can then be either post-fused or duplexed for retransfixing or finishing. The details of for both processes will now be more fully described below.

A supporting surface 14 which is shown in FIGS. 1 and 2 as a drum, but may also be a web, platen, belt, band or any other suitable design (hereinafter "drum 14"), is coated with an elastomer layer which defines a release surface 8. The intermediate transfer surface can be an oiled transfix roller surface or a liquid layer 12 applied to the release surface 8 on drum 14 by contact with an applicator assembly 16, such as a liquid impregnated web, wicking pad, roller or the like. By way of example, but not of limitation, applicator assembly 16 can include a wicking roller or pad of fabric or other material impregnated with a release liquid for applying the liquid and a metering blade 18 for consistently metering the liquid on the surface of the drum 14. Suitable release liquids that may be employed to form the intermediate transfer surface 12 include water, fluorinated oils, glycol, surfactants, mineral oil, silicone oil, functional oils or combinations thereof. As the drum 14 rotates about a journaled shaft in the direction shown in FIGS. 1 and 2, applicator assembly 16 is raised by the action of an applicator assembly cam and cam follower (not shown) until the wicking roller or pad is in contact with the surface of the drum 14. The release liquid, retained within the wicking roller or pad is then deposited on the surface of the drum 14. An exemplary intermediate transfer surface application system, and the details thereof, are fully disclosed in commonly assigned U.S. Pat. No. 5,805,191 to Jones et al., hereby incorporated by reference.

Referring once again to FIGS. 1 and 2, the release liquid that forms the intermediate transfer surface 12 on release surface 8 is heated by an appropriate heater device 19. The heater device 19 may be a radiant resistance heater positioned as shown or positioned internally within the drum 14. Heater device 19 increases the temperature of the intermediate transfer surface 12 from ambient temperature to between 25 degrees to about 70 degrees centigrade or higher to receive the ink from print head 11. This temperature is dependent upon the exact nature of the liquid employed in the intermediate transfer surface 12 and the ink used and is adjusted by temperature controller 40 utilizing thermistor 42. Ink is then applied in molten form from about 85 degrees to about 150 degrees centigrade to the exposed surface of the liquid intermediate transfer surface 12 by the print head 11 forming an ink image 26. The ink image 26 solidifies on the intermediate transfer surface 12 by cooling down to the malleable intermediate state temperature provided by heating device 19.

In one embodiment, a receiving substrate guide apparatus 20 then passes the receiving substrate 28, such as paper or transparency, from a positive feed device (not shown) and guides it through a nip 29, as shown in FIG. 1. Opposing accurate surfaces of a roller 23 and the drum 14 forms the nip 29. In this arrangement, the roller 23 has a metallic core, preferably steel with an elastomer coating 22. The drum 14 having release surface 8 continues to rotate, entering the nip 29 formed by the roller 22 with the curved surface of the intermediate transfer surface 12 containing the ink image 26. The roller 23 is moved downward onto substrate 28 once the leading edge of substrate 28 has entered nip 29. The ink image 26 is then deformed to its image conformation and adhered to the receiving substrate 28 by being pressed there against. Once the trailing edge of substrate 28 exits the nip 29, roller 23 is stopped and lifted from the substrate 28. In this manner roller 23 does not come into contact with surface 12. The elastomer coating 22 on roller 23 engages the receiving substrate 28 only on the reverse side to which the ink image 26 is transferred.

In another embodiment as shown in FIG. 2, receiving substrate guide apparatus 20 passes the receiving substrate 28, such as paper or transparency, from a positive feed device (not shown) and guides it through a nip 39. Opposing accurate surfaces of a roller 33 and the drum 14 forms the nip 39. In this arrangement, the roller 33 can have a metallic core, preferably steel with an elastomer coating 32. The drum 14 having release surface 8 continues to rotate, entering the nip 39 formed by the roller 32 with the curved surface of the intermediate transfer surface 12 containing the ink image 26. The roller 33 maintains e contact with surface 12 before, during and after substrate 29 passes through the nip 39. The ink image 26 is deformed to its image conformation and adhered to the receiving substrate 28 by being pressed there against. In this manner, roller 33 remains in contact with surface 12. The elastomer coating 32 on roller 33 engages the liquid layer forming the intermediate transfer surface 12 before and after substrate 28 has passed through nip 39.

In this process, the ink image 26 is first applied to the intermediate transfer surface 12 on the elastomer surface 8 of the rotating drum 14 and then transfixed off onto the receiving substrate or media 28. It should be understood that the thicker the elastomer surface 8 the higher the transfer efficiency due to its ability to conform around the primary and secondary ink spots and paper roughness. A thickness in accordance with higher transfer efficiency is approximately between 40 to 200 microns. It should also be understood that the thinner the elastomer surface 8 that the ink image spreads and flattens and is penetrated into the paper. A thickness in accordance with a higher drop spread is approximately between 5 to 40 microns. The ink image 26 is thus transferred and fixed to the receiving substrate 28 by the pressure exerted on it in the nip 29 by the resilient or elastomeric surface 22 of the roller 23. By way of example only, the pressure exerted may be less than 800 lbf on the receiving substrate or media. Stripper fingers 25 (only one of which is shown) may be pivotally mounted to the imaging apparatus 4 to assist in removing any paper or other final receiving substrate 28 from the exposed surface of the liquid layer forming the intermediate transfer surface 12. After the ink image 26 is transferred to the receiving substrate 28 and before the next imaging, the applicator assembly 16 and metering blade 18 are actuated to rise upward into contact with the drum 14 to replenish the liquid intermediate transfer surface 12.

FIGS. 1 and 2 diagrammatically illustrates the sequence involved when the ink image 26 is transferred from the liquid layer forming the intermediate transfer surface 12 to the final receiving substrate 28. As seen in FIG. 2, the ink image 26 transfers to the receiving substrate 28 with a small, but measurable quantity of the liquid in the intermediate transfer surface 12 attached thereto as an outer layer. The average thickness of the transferred liquid layer is calculated to be about 0.8 micrometers. Alternatively, the quantity of transferred liquid layer can be expressed in terms of mass as being from about 0.1 to about 200 milligrams, and more preferably from about 0.5 to about 50 milligrams per page of receiving substrate 28. This is determined by tracking on a test fixture the weight loss of the liquid in the applicator assembly 16 at the start of the imaging process and after a desired number of sheets of receiving substrate 28 have been imaged.

Referring again to FIGS. 1 and 2, after exiting the nip 29, 39 created, respectively, by the contact of the roller 23, 33 and the elastomer layer 8 and drum 14, the ink image can then be thermally controlled with a thermal device 60. This thermal device 60 can heat, cool, or maintain the temperature of the receiving substrate 28 and ink image 26 which may by way of example be between 50 to 100 degrees C. The highest temperature the receiving substrate 28 and ink image 26 can be increased to in this location is dependent on the melting or flash point of the ink and/or the flash point of the receiving substrate 28. The thermal device 60 could be as simple as insulation to maintain the temperature of the ink and substrate as it exits the nip 29, or a heating and/or cooling system to add or remove thermal energy.

Figure 3:
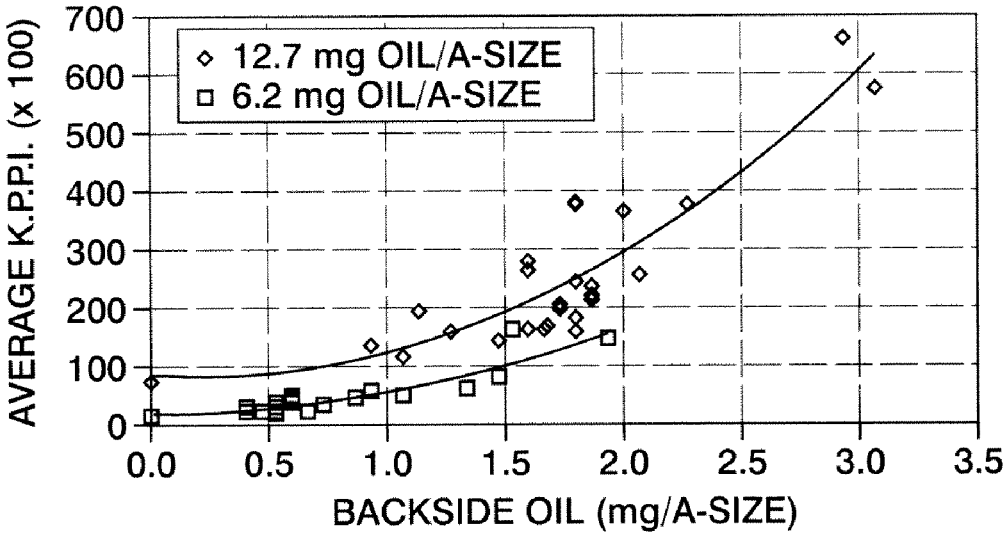
FIG. 3 is a chart illustrating the relationship between the back side or dependence and duplex dropout.
Figure 4:
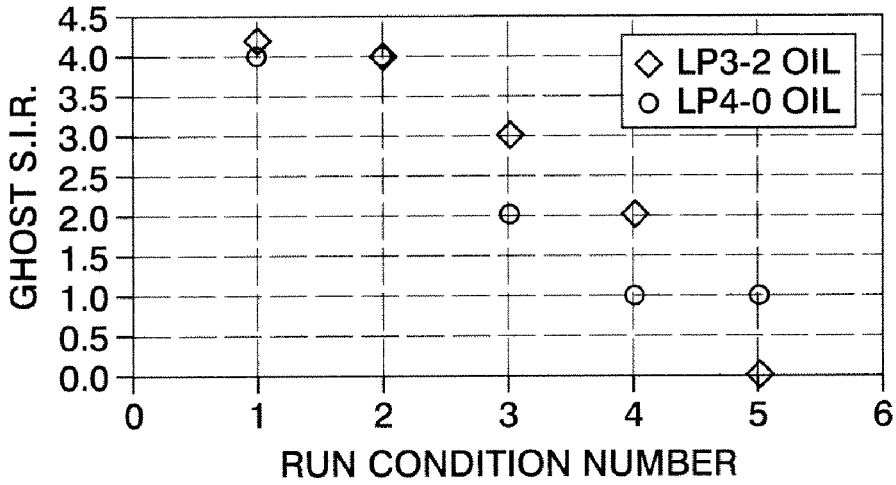
FIG. 4 is a chart illustrating the roller ghosting level and, dependence on a transfix roll for various run conditions.

This disclosure provides for the elastomer coating 22 on roller 23 (FIG. 1) in the first ink jet printers to be oil free in the first side printed in order to minimize duplex dropout but yet in the second ink jet printer, the elastomer coating 32 on roller 33 (FIG. 2) can be oiled sufficiently for the second side printed to mitigate duplex offset, gloss degradation, and roller ghosting. This can be accomplished by having, for example, a first engine 2 dedicated to first side printing and another second engine 4 dedicated to second side printing. The extension beyond two engines can include pairing of engines to separate out the first side printed from the second side printed. FIG. 3 shows the dependence of duplex dropout on backside oil which demonstrates the advantage of a non-oiled transfix roller surface 12 for the first side printed. FIG. 4 shows how the roller ghosting is effected by the oil on the transfix roller surface. Run condition number one (1) provides no oil; run condition number two (2) provides oil to the transfix roller surface via an oiled drum touch only. The entire process of oiling the transfix roll surface is called a Mid-Duplex Oiling, MDO; run condition number three (3) provides MDO and Roll-on whereby the transfix roll touches the oiled drum; run condition number four (4) provides MDO, Roll-on, and Extra roll off which holds the transfix roll against the oiled drum purposely to provide oil to the transfix roll surface; and, run condition number five (5) provides MDO, Roll-on, Extraroll-off, and a cleanup reduced cleanup distance which leaves more oil on the transfix roll surface following a simplex print job. The resultant ghost standard image reference (SIR) is therein displayed in FIG. 4. The proposal for this disclosure would allow the second side printed engine to have multiple transfix roller surface to drum touches which maintains an oiled transfix roll surface before and during the printing sequence since the constraint of duplex dropout is removed from that print engine which would enable the improved run conditions as shown in FIG. 4. Similar data can be expected for duplex gloss and offset.

Figure 5:
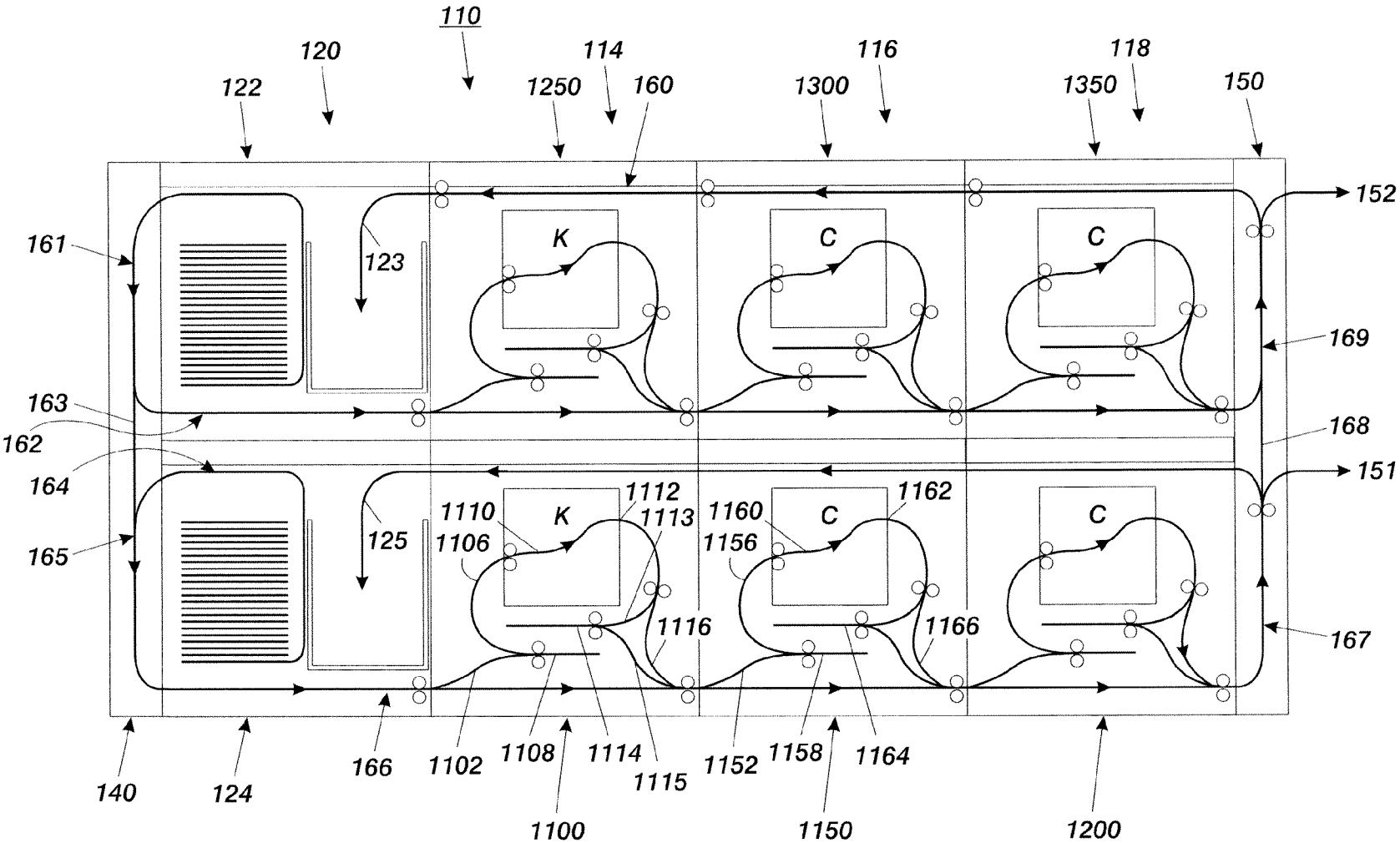
FIG. 5 is a sectional view showing an exemplary arrangement of image marking engines and media feeder modules.

The embodiments, to be described below, include a plurality of Image Marking Engines (IME) and feeder modules. The IMEs can be, for example, any type of ink-jet printer, a xerographic printer, a thermal head printer that is used in conjunction with heat sensitive paper, or any other apparatus used to mark an image on a substrate. The IMEs can be, for example, black only (monochrome) and/or color printers. Examples of different varieties of black and color printers are shown in FIG. 5, but other varieties, types, alternatives, quantities, and combinations can be used within the scope of the described embodiments. It is to be appreciated that, each of the IMEs can include an input/output interface, a memory, a marking cartridge platform, a marking driver, a function switch, a controller and a self-diagnostic unit, all of which can be interconnected by a data/control bus. Each of the IMEs can have a different processing speed capability. The feeder modules can include "garbage cans" or discard areas (paths) to be described hereinafter.

Each marking engine can be connected to a data source over a signal line or link. The data source provides data to be output by marking a receiving medium. In general, the data source can be any of a number of different sources, such as a scanner, a digital copier, a facsimile device that is suitable for generating electronic image data, or a device suitable for storing and/or transmitting the electronic image data, such as a client or server of a network, or the internet, and especially the worldwide web. The data source may also be a data carrier such as a magnetic storage disk, CD ROM, or the like, that contains data to be output by marking. Thus, the data source can be any known or later developed source that is capable of providing scanned and/or synthetic data to each of the marking engines.

The link can be any known or later developed device or system for connecting the image data source to the marking engine, including a direct cable connection, a public switched telephone network, a wireless transmission channel, a connection over a wide area network or a local area network, a connection over an intranet, a connection over the internet, or a connection over any other distributed processing network or system. In general, the link can be any known or later developed connection system or structure usable to connect the data source to the marking engine. Further, it should be appreciated that the data source may be connected to the marking engine directly.

As shown in FIG. 5 and to be described hereinafter, multiple marking engines are shown tightly coupled to or integrated with one another in one illustrative combination thereby enabling high speed printing and low run costs, with a high level of up time and system redundancy. The marking engines are supplied with media by, for example, two integrated feeder modules.

Referring to FIG. 5, a printing system 110 having a modular architecture is shown which employs a vertical frame structure that can hold at least two marking engines and feeder modules. The printing system provides horizontal media paths or transport highways. The modular architecture can alternatively include a separate frame structure around each marking engine and feeder module and/or transport highway. The frame structure contains features to allow both horizontal and vertical docking of the marking engines and feeder modules. The frame structure includes horizontal and vertical walls compatible with other marking engines and feeder modules. The image marking engines and feeder modules can be cascaded together with any number of other marking engines to generate higher speed configurations. It is to be appreciated that each marking engine can be disconnected (i.e. for repair) from the printing system while the rest of the system retains its processing capability.

By way of example, the integrated printing system 110 having three vertical towers 114, 116, 118 comprising six IMEs, 1100, 1150, 1200, 1250, 1200, and 1250 is shown in FIG. 5. The integrated printing system 110, as shown, further includes a paper/media feeding tower portion 120 comprising two feeder modules 122, 124. The system 110 can include a finishing tower (not illustrated) comprising two, for example, paper/media finishing or stacking portions 151, 152. The system 110 further includes a feed or input endcap module 140 and a finisher or output endcap module 150 for media recirculating within, and media exiting from, the system. Between the endcaps 140, 150 are the six contained and integrated image marking engines 1100, 1150, 1200, 1250, 1200, 1250 and the two feeder modules 122, 124. It is to be appreciated that more and other combinations of color and black marking engines can be utilized in any number of configurations, and that the image marking engines can comprise the configuration of ink jet printers 2 and/or 4, as described above.

In operation, media exits the feeding tower portion 120 into the input module 140 and then onto the horizontal media highways whereby the media enters the integrated marking engines area.

The architecture, described above, enables the use of multiple marking engines within the same system and can provide single pass duplexing. Single pass duplexing refers to a system in which side one of a sheet is printed on one marking engine, and side two is printed on a second marking engine instead of recirculating the sheet back into the first engine.

In the configuration of FIG. 5, it is to be appreciated that single pass duplexing can be accomplished by any two marking engines, for example IMEs 1100 and 1150, oriented substantially horizontally to one another, where the second IME 1150 is positioned downstream from the first or originating marking engine 1100. Alternatively, single pass duplexing can be accomplished by any pair of marking engines oriented vertically, horizontally, or non-adjacent, to one another.

Although not illustrated, it is to be appreciated that at intersections along the horizontal highways and at alternative routes entering and exiting the IMEs, switches or dividing members are located and constructed so as to be switchable to allow sheets or media to move along one path or another depending on the desired route to be taken. The switches or dividing members can be electrically switchable between at least a first position and a second position. An enabler for reliable and productive system operation includes a centralized control system that has responsibility for planning and routing sheets, as well as controlling the switch positions, through the modules in order to execute a job stream.

Four separate horizontal highways or media paths 160, 162, 164, 166 are displayed along with their respective media passing directions. An upper horizontal return highway 160 moves media from right to left, a central horizontal forward highway 162 moves media from left to right, a central horizontal return highway 164 moves media from right to left, and a lower horizontal forward highway 166 moves media from left to right. The input module 140 positioned to the left of the feeding tower 120 accepts sheets or media from the feeder modules 122, 124 and delivers them to the central forward 162 and lower forward 166 highways. The output module 150 located to the right of the last vertical marking engine tower 118 receives sheets from the central forward 162 and the lower forward 166 highways and delivers them in sequence to finishing devices 151, 152 or recirculates the media by way of return paths 160, 164. Although the movements of paths 160, 162, 164, 166 generally follow the directions described above, it is to be appreciated that paths 160, 162, 164, 166, or segments thereof, can intermittently move in an opposing direction to allow for media transport path routing changes.

A capability shown in FIG. 5 is the ability of media to be marked by any first IME and then by any one or more subsequent IME to enable, for example, single pass duplexing and/or multi-pass printing. The elements that enable this capability are the return highways 160, 164, inverter bypasses, and the input and output modules 140, 150. The return highways 160, 164 are connected to, and extend between, both input and output modules 140, 150, allowing, for example, media to first be routed to the lower right IME 1200, then up to the top of the output module 150, and then back along the upper return highway 160 to the input module 140, and thence to the upper left IME 1250. Media can be discarded from paths 160 and 164 by way of discard paths 123 and 125, prior to entering paths 161 and 165.

With reference to one of the marking engines, namely marking engine 1100, the media paths will be explained in detail below. The media originating from the feeding tower 122 can enter the input distributor module 140 and travels to the lower horizontal forward highway 166 by way of paths 161, 163 and/or 165. It is to be appreciated that the media alternatively can be routed, or recirculated, by way of return highways 160, 164. The media can exit the horizontal highway 166 at highway exit 1102. Upon exiting the horizontal highway 166 along path 1102, the media travels into a staging portion or input inverter 1108. Thereupon, the media enters the processing portion of marking engine 1100 via path 1106 and is transported through a processing path 1110 of the marking engine 1100 whereby the media receives an image. Next, the media exits the processing path 1110 at point 1112 and can take alternate routes therefrom. Namely, the media can enter another staging portion or output inverter 1114 or can travel by way of a bypass path 1116 of the output inverter 1114 to the horizontal highway 166 for exiting the IME 1100. Media entering output inverter travels by way of path 1112 into inverter 1114 and exits by way of path 1115.

With reference now to another marking engine, namely marking engine 1150, the media paths will be explained in detail below. The media originating from the feeding tower 122, or indirectly from another IME, can enter the input distributor module 140 and travels to the lower horizontal forward highway 166. It is to be appreciated that the media alternatively can be routed, or recirculated, by way of return highways 160, 164. The media can exit the horizontal highway 166 at highway exit 1152. Upon exiting the horizontal highway 166 along path 1152, the media travels into a staging portion or input inverter 1158. The media then enters the processing portion of marking engine 1150 via path 1156 and is transported through a processing path 1160 of the marking engine 1150 whereby the media receives an image. Next, the media exits the processing path 1160 at point 1162 and can take alternate routes therefrom. Namely, the media can enter another staging portion or output inverter 1164 or can travel via a bypass path 1166 of the output inverter 1164 to the horizontal highway 1166 for exiting the IME 1150. Upon exiting IME 1150, the media can move by way of path 167 to return highway 164 or a finisher 151, or can alternatively move by way of paths 168 and 169 to return highway 160 or can exit to finisher 152.

In FIG. 5, the IMEs are shown in arbitrary configurations. Optimal relative locations of the IMEs are dependent upon analysis of customer usage demographics, such as the split between black only duplex versus color duplex jobs frequency.

As shown in FIG. 5, each of the marking engines can include a pair of inverter subsystems, for example 1108 and 1114. The inverters can serve a function for media entering or exiting a highway: In particular, the inverters invert sheets for duplex printing. It is to be appreciated that each container module paper path could include a bypass path for the input inverter (not illustrated) and/or a bypass path for the output inverter 216. In this manner, media can bypass either or both inverters to enable multi-pass printing.

The modular media path architecture provides for a common interface and highway geometry which allows different marking engines with different internal media paths together in one system. The modular media path includes entrance and exit media paths which allow sheets from one marking engine to be fed to another marking engine, either in an inverted or in a non-inverted orientation.

The modular architecture enables a wide range of marking engines in the same system. As described above, the marking engines can involve a variety of types and processing speeds. The modular architecture can provide redundancy for marking engines and paths. The modular architecture can utilize a single media source on the input side and a single output merging module on the output side. The output merging module can also provide optional inversion, bi-directional media movement, and multiple output locations. It is to be appreciated that an advantage of the system is that it can achieve very high productivity (prints per minute), using marking processes selectively in subsystems. Although not shown, other versions of the modular architecture can include an odd number of marking engines. For example, three marking engines can be configured such that two are aligned vertically and two are aligned horizontally, wherein one of the marking engines is common to both the vertical and horizontal alignment.

The modular architecture enables single pass duplexing, multi-pass color processing, redundant duplex loops which provide a shorter media path that maximizes reliability and duplex productivity.

The present embodiments have been described with a degree of particularity. The marking engines utilized in combination with the described embodiments could be modified and/or substituted with different types of marking mechanisms, for example, other than ink jet printers. The performance criteria for the particular xerographic marking engines can also vary when other marking systems are substituted. For these reasons, it is the intent that all design modifications or alterations falling within the spirit or scope of the appended claims be protected by the present application.

While the disclosure has been described above with reference to specific embodiments thereof, it is apparent that many changes, modifications and variations in the materials, arrangements of parts and steps can be made without departing from the inventive concept disclosed herein. Accordingly, the spirit and broad scope of the appended claims is intended to embrace all such changes, modifications and variations that may occur to one of skill in the art upon a reading of the disclosure. All patent applications, patents and other publications cited herein are incorporated by reference in their entirety.

What is claimed is:

1. A method for controlling printing in a solid ink jet printing system, the method comprising:

forming a first ink image and a second ink image on a first transfer surface and a second transfer surface, respectively;

passing a receiving substrate through a first nip simplex path of a first ink jet printer at a first print speed wherein the first ink jet printer is selectively dedicated to a first side printing;

exerting a first pressure on the receiving substrate in the first nip to transfer the first ink image from the first transfer surface to a first side of the receiving substrate;

moving the receiving substrate through an inverter path;

passing the receiving substrate through a second nip simplex path of a second ink jet printer at a second print speed;

exerting a second pressure on the receiving substrate in the second nip to transfer the second ink image from the second transfer surface to a second side of the receiving substrate;

wherein the passing the receiving substrate through the first nip is between a first drum and a first roller, the first roller includes a selectively non-oiled transfix roller surface;

wherein the passing the receiving substrate through the second nip is between a second drum and a second roller, the second roller includes a selectively oiled transfix roller surface;

wherein the first print speed of the first ink jet printer is slower than the second print speed of the second ink jet printer;

wherein the transfer of the first ink image and the transfer of the second ink image include a single pass duplexing operation; and, the print speed of the first ink jet printer plus the print speed of the second ink jet printer is faster than a print speed of a multiple pass duplexing operation of the substrate through the first ink jet printer or the second ink jet printer.

2. The method of claim 1, further comprising a first forward substantially horizontal interface media transport between the first ink jet printer and the second ink jet printer for transporting the receiving substrate from the first ink jet printer to the second ink jet printer.

3. An apparatus for controlling printing in an ink jet printing system comprising:

a first ink image and a second ink image formed on a first transfer surface and a second transfer surface, respectively;

a receiving substrate passed through a first nip of a first ink jet printer at a first print speed;

the first nip is between a first roller and a first drum, wherein the first roller includes a selectively non-oiled transfix roller surface;

a first pressure exerted on the receiving substrate in the first nip to transfer the first ink image from the first transfer surface to a first side of the receiving substrate;

the receiving substrate pulled through an inverter path;

the receiving substrate passed through a second nip of a second ink jet printer at a second print speed;

a second pressure exerted on the receiving substrate in the second nip to transfer the second ink image from the second transfer surface to a second side of the receiving substrate;

the second nip is between a second roller and a second drum, the second roller includes a selectively oiled transfix roller surface; and, the first ink jet printer is selectively dedicated to a first side printing and the second ink jet printer is selectively dedicated to a second side printing.

4. The apparatus of claim 3, wherein the first print speed of the first ink jet printer is slower than the second print speed of the second ink jet printer.

5. The apparatus of claim 4, wherein the transfer of the first ink image and the transfer of the second ink image include a single pass duplexing operation; and, the print speed of the first ink jet printer plus the print speed of the second ink jet printer is faster than a print speed of a multiple pass duplexing operation of the substrate through the first ink jet printer or the second ink jet printer.

6. The apparatus according to claim 5, wherein the selectively oiled transfer roller surface includes a compliant layer defining the intermediate transfer surface.

7. The apparatus according to claim 6, wherein the receiving substrate is paper.

8. An ink jet print application system comprising:

a first ink image and a second ink image formed on a first transfer surface and a second transfer surface, respectively;

a receiving substrate passed through a first nip of at least one ink jet printer at a first print speed;

the first nip is between a first roller and a first drum, the first roller includes a non-oiled transfix roller;

a first pressure exerted on the receiving substrate in the first nip to transfer the first ink image from the transfer surface to a first side of the receiving substrate;

the receiving substrate pulled through an inverter path;

the receiving substrate passed through a second nip of at least another ink jet printer at a second print speed;

a second pressure exerted the receiving substrate in the second nip to transfer the second ink image from the transfer surface to a second side of the receiving substrate;

the second nip is between a second roller and a second drum, the second roller includes an oiled transfix roller;

circulating the receiving substrate from said at least one ink jet printer to an input module for distribution of the receiving substrate in a selected order to and from at least one ink jet printer by way of at least one forward substantially horizontal media transport and at least one return substantially horizontal media transport wherein the receiving substrate selectively enters and exits any one of the ink jet printers and selectively enters any other one of the ink jet printers;

wherein the first nip of the at least one ink jet printer is dedicated to first side printing of the receiving substrate and the second nip of the at least another ink jet printer is dedicated to the second side printing of the receiving substrate for single pass duplexing of the receiving substrate;

wherein the transfer of the first ink image and the transfer of the second ink image include single pass duplexing; and;

the first print speed of the at least one ink jet printer plus the second print speed of the at least another ink jet printer is faster than a print speed of multiple pass duplexing of the substrate through the at least one ink jet printer or the at least another ink jet printer.

9. The ink jet print application system of claim 8, wherein the at least one forward substantially horizontal media transport circulates the receiving substrate selectively to and from the at least one ink jet printer, the at least another ink jet printer, and selectively bypassing at least a third image marking engine.

10. The ink jet print application system of claim 9, wherein the second print speed is faster than the first print speed.

11. The ink jet print application system of claim 9, wherein the at least forward substantially horizontal media transport includes an inverter between the at least one ink jet printer and the at least another ink jet printer for transporting and inverting the receiving substrate from the at least one ink jet printer to the at least another ink jet printer.

* * * * *